US006006060A

United States Patent [19]

Sato

[11] Patent Number: 6,006,060

[45] Date of Patent: Dec. 21, 1999

[54] IMAGE-FORMING APPARATUS WITH POTENTIAL APPLIED TO LAYER THICKNESS RESTRICTING BLADE

[75] Inventor: Shougo Sato, Seto, Japan

[73] Assignee: Brother Kogyo Kabushiki Kaisha, Nagoya, Japan

[21] Appl. No.: 09/233,189

[22] Filed: Jan. 20, 1999

[30] Foreign Application Priority Data

Jan. 23, 1998 [JP] Japan ..... 10-11730

[51] Int. Cl.[6] ..... G03G 15/08

[52] U.S. Cl. ..... 399/284; 399/274

[58] Field of Search ..... 399/284, 274, 399/265, 279, 55, 285

[56] References Cited

U.S. PATENT DOCUMENTS

| | | | |
|---|---|---|---|
| 4,640,880 | 2/1987 | Kawanishi et al. . | |
| 4,663,262 | 5/1987 | Oka et al. . | |
| 5,506,084 | 4/1996 | Ohta et al. . | |
| 5,608,501 | 3/1997 | Makino . | |
| 5,708,940 | 1/1998 | Hosaka et al. | 399/266 |
| 5,771,427 | 6/1998 | Makino . | |
| 5,887,233 | 3/1999 | Abe et al. | 399/284 |

FOREIGN PATENT DOCUMENTS

| | | |
|---|---|---|
| 59-182464 | 10/1984 | Japan . |
| 61-151551 | 7/1986 | Japan . |
| 7-191493 | 7/1995 | Japan . |
| 7-225514 | 8/1995 | Japan . |

*Primary Examiner*—Arthur T. Grimley
*Assistant Examiner*—Quana Grainger
*Attorney, Agent, or Firm*—Oliff & Berridge, PLC

[57] ABSTRACT

An image-forming apparatus is provided that can form good images stably by uniformly and stably charging a non-magnetic single-component developer (such as a toner). In this apparatus, a DC power supply applies a positive voltage Vd to a development roller, and a DC power supply applies a positive voltage Vb to a layer thickness restricting blade. The voltages Vb and Vd satisfy the relationship Vb>Vd+Vt, where Vt is the potential difference in a thickness direction of the layer of toner T adhering to the development roller. The toner T is a suspension polymer toner excelling in fluidity. Accordingly, toner T charged with reverse polarity can be nicely removed. In addition, the action of injecting electric charge to the toner T by the application of the potential Vb to the layer thickness restricting blade 32 is not produced and, even without that action, the toner T can be sufficiently charged by friction-charging produced by the development roller and the supply roller working together. Thus the toner T can be uniformly and stably charged.

6 Claims, 4 Drawing Sheets

IMAGE-FORMING APPARATUS WITH POTENTIAL APPLIED TO LAYER THICKNESS RESTRICTING BLADE

BACKGROUND OF THE INVENTION

1. Field of the Invention

This invention relates to an image-forming apparatus that transfers a developer to a recording medium to form an image, and more particularly to an image-forming apparatus that forms images with a charged non-magnetic single-component developer 2. Description of the Related Art Image-forming apparatuses are known in the prior art which comprise an electrostatic latent image carrier such as a photosensitive drum on the surface of which electrostatic latent images are formed, development means that convey a developer such as a toner to the surface of the electrostatic latent image carrier and thus develop the electrostatic latent images, supply means for supplying the developer to the development means, and layer thickness restricting means for restricting the thickness of the developer layer adhering to the surface of the development means before the developer faces to the electrostatic latent image carrier. With this type of image-forming apparatus, the developer is conveyed to the surface of the electrostatic latent image carrier by the supply means and development means, the electrostatic latent images are developed by that developer, and the images are then formed by transferring the developer to a recording medium. The thickness of the developer layer is restricted by the layer thickness restricting means before it faces to the electrostatic latent image carrier, so that images can be formed in a uniform density.

As the developer noted above, two types are known, namely one being a two-component developer system containing a toner and a carrier, and the other being a single-component developer system containing no carrier. In recent years, in the interest of maintaining image-forming apparatuses with ease and making them more compact, instead of the two-component systems, single-component developer systems have come into wide use. With single-component developer systems, a substance corresponding to the carrier is contained in the toner, and, when the toner is moved using magnetic force, the toner is made to contain magnetic materials. However, the magnetic materials are opaque, and hence especially with color development, it is more suitable to use a non-magnetic developer. That being so, in recent years, it is becoming increasingly common to use a non-magnetic single-component developer in electrophotographic image-forming apparatuses that form images by transferring a developer such as toner to a recording medium.

A non-magnetic single-component developer is charged either positively or negatively, and develops the electrostatic latent images using electrostatic attraction. The known methods for charging the toner or other non-magnetic single-component developers include a method wherein a toner is rubbed together by, e.g., rollers (in some cases functioning as both of the supply means and development means noted earlier), thereby friction-charging the toner, and a method wherein layer thickness restricting means is made of an electrically conductive material, and the toner is charged by injecting electrical charges into the toner via the layer thickness restricting means.

With either of the methods noted above, however, it is very difficult to charge the toner uniformly and stably, as discussed below. Accordingly, good images cannot be formed stably with conventional image-forming apparatuses.

More specifically, a toner that adheres to the surface of the development means in a layer the thickness of which is restricted is not all available for development; a portion thereof remains adhering to the surface of the development means. Development means are often constituted with, e.g., rollers. In the former of the two methods that is based on friction-charging, the toner that remains adhering to the development means is again subjected to friction-charging. When that happens, the amount of friction-charging becomes excessive in some of the toner, so that it adheres strongly to the development means and sometimes hinders the charging of other toner. As a consequence, adequate friction-charging is not effected in the toner, so that not only the image density declines, but inter-toner friction increases, and in some cases friction-charging of a polarity opposite to the desired charging polarity occurs. This results in so-called inverse fogging wherein toner adheres to the background in electrostatic latent images on the electrostatic latent image carrier.

With a non-magnetic single-component developer, in particular, charging speed is slow compared to the case of a two-component developer system, and when forming images in a low-temperature, low-humidity environment, fogging readily occurs, immediately after replenishing the toner with new toner, or when forming images after the toner has deteriorated. In addition, even worse fogging tends to occur in areas connecting to black solid printed areas where much toner is consumed.

In order to resolve these problems, the latter of the two methods, namely the method based on electrical charge injection, has been conceived. With this latter method, however, charging efficiency is highly dependent on the resistance of the toner, and so is readily affected by the environment, such that it is very difficult to control the amount of charging in the developer. If the toner resistance is made sufficiently small or innovations are made in the additives, it may be possible to reduce occurrences of fogging, but, depending on the environment, there is the possibility of transfer faults occurring or of a decline in fine line reproducibility.

SUMMARY OF THE INVENTION

An object of the present invention is to provide an image-forming apparatus that is capable of stably forming good images by uniformly and stably charging a non-magnetic single-component developer.

In order to achieve the object stated above, the present invention provides an image-forming apparatus comprising:

- an electrostatic latent image carrier on the surface of which electrostatic latent images are formed;
- development means for conveying charged non-magnetic single-component developer to the surface of the electrostatic latent image carrier and developing the electrostatic latent images;
- supply means for supplying the non-magnetic single-component developer to the development means; and
- layer thickness restricting means for restricting the layer thickness of the non-magnetic single-component developer adhering to a surface of the development means before the non-magnetic single-component developer faces to the electrostatic latent image carrier, at least a part of the layer thickness restricting means contacting the non-magnetic single-component developer adhering to the surface of the development means is made of an electrically conductive material, where the non-magnetic single-component developer that has developed the electrostatic latent images is transferred to a recording medium, thereby forming images; wherein the non-magnetic single-component developer is roughly spheroidal in shape;

the development means, the supply means, and the layer thickness restricting means are constituted so that the non-magnetic single-component developer can be sufficiently charged for development of the electrostatic latent images, even if the layer thickness restricting means is given the same electric potential as the development means; and the image-forming apparatus further comprises:

electric potential control means for controlling potential Vb of the layer thickness restricting means so that conditions noted below are satisfied, at least during image formation;

condition 1 being that the potential Vb satisfies the following relationships:

Vb>Vd+Vt; when as the non-magnetic single-component developer is used a positive-chargeable non-magnetic single-component developer, and Vb<Vd+Vt; when as the non-magnetic single-component developer is used a negative-chargeable non-magnetic single-component, where Vd is voltage applied to the development means during image formation, and Vt is a potential difference in a thickness direction of a layer of the non-magnetic single-component developer adhering to the development means; and condition 2 being that the amount of charging per unit mass of the non-magnetic single-component developer adhering to the development means is roughly equal to that when the layer thickness restricting means has the same potential as the development means.

The inventor discovered that, if at least the part of the layer thickness restricting means that comes into contact with the non-magnetic single-component developer adhering to the surface of the development means is formed from of an electrically conductive material and, at the same time, the potential Vb on the layer thickness restricting means is controlled to a potential that satisfies condition 1 noted above, non-magnetic single-component developer charged in reverse polarity can be effectively removed by the layer thickness restricting means. In the present invention, the potential Vb is controlled to a potential that satisfies condition 1 above by potential control means, and additionally a non-magnetic single-component developer that is roughly spheroidal and excellent in fluidity is used, so that the non-magnetic single-component developer that is charged in reverse polarity adhering to the surface of the development means can be very well removed.

The potential Vb, moreover, is set so that the amount of charging per unit mass of non-magnetic single-component developer adhering to the development means when that potential Vb is applied to the layer thickness restricting means is roughly equal to that when the layer thickness restricting means is made to have the same potential as the development means (condition 2), and, in addition, the development means, supply means, and layer thickness restricting means are constituted so that the non-magnetic single-component developer can be sufficiently charged for the development of the electrostatic latent images, even should the layer thickness restricting means be made to have the same potential as the development means. In other words, the present invention is constituted so that, without utilizing positively the action of electric charge injection to the non-magnetic single-component developer by the application of the potential Vb to the layer thickness restricting means, the non-magnetic single-component developer can be sufficiently charged, even when that action is not present, eg., with friction-charging. Accordingly, the charging of the non-magnetic single-component developer is hardly influenced by environment, as compared with when the non-magnetic single-component developer is charged by electrical charge injection. Additionally, the amount of charging of the non-magnetic single-component developer does not become excessive by electrical charge injection when it passes through the layer thickness restricting means.

Accordingly, in the present invention, the non-magnetic single-component developer can be uniformly and stably charged, whereby good images can be stably formed. With the present invention, moreover, the amount of reverse polarity charged magnetic single-component developer removed is only a small portion as compared to the entire amount of non-magnetic single-component developer conveyed by the development means, and so it normally hardly occurs at all. For this reason, the amount of charging per unit mass of non-magnetic single-component developer will hardly be changed at all by the removal of the non-magnetic single-component developer charged in reverse polarity, so that condition 2 above continues to be satisfied. It is not necessary that the amounts of charging in condition 2 exactly coincide; the same action and effect are seen even when they differ within a range of ±5%.

In the present invention, it is preferable that the non-magnetic single-component developer comprises a polymeric toner obtained by polymerization.

Polymeric toners obtained by polymerization are known to exhibit extremely good fluidity, being more nearly spheroidal than other non-magnetic single-component developers. In the present invention, as the non-magnetic single-component developer, such a polymeric toner is used, so that the removal of non-magnetic single-component developer charged in reverse polarity can be accomplished effectively by the layer thickness restricting means. That being so, with the present invention, the non-magnetic single-component developer can be charged more uniformly and more stably, and therefore, in addition to the benefits mentioned above, there is obtained the benefit of being able to form better images more stably.

In addition, it is preferably that the polymeric toner is a suspension-polymeric toner obtained by suspension polymerization.

Suspension-polymeric toners obtained by suspension polymerization are known to be more nearly spheroidal than other polymer toners, and to exhibit better fluidity. In the present invention, such a suspension polymer toner is preferably used as the non-magnetic single-component developer, so that the removal by the layer thickness restricting means of the nonmagnetic single-component developer charged in reverse polarity can be accomplished effectively. That being so, with the present invention, in addition to the benefits mentioned, there is further obtained the benefit that the non-magnetic single-component developer can be charged more uniformly and more stably, whereby even better images can be formed even more stably.

In addition, additives subjected to a hydrophobic treatment and having a mean particle diameter of 30 nm or less are preferably added in a quantity of approximately 0.5 wt % or greater to the non-magnetic single-component developer.

It is known that an additive having a mean particle diameter of 30 nm or less will exhibit no aggregation of the non-magnetic single-component developer when they collide with each other, and hence the addition thereof further improves the fluidity of the non-magnetic single-component developer. If the additive is subjected to a hydrophobic treatment, moreover, it is prevented from absorbing moisture and adhering to other substances, making it possible to further improve the fluidity of the non-magnetic single-component developer. In the present invention, such additives are added to the non-magnetic single-component developer in a quantity of approximately 0.5 wt % or more, whereby the fluidity of the non-magnetic single-component developer is improved greatly. Accordingly, the removal by the layer thickness restricting means of the non-magnetic single-component developer charged in reverse polarity can be accomplished effectively. That being so, with the present invention, in addition to the benefits mentioned above, there is obtained the additional benefit that the non-magnetic single-component developer can be charged more uniformly and more stably, whereby even better images can be formed even more stably.

In addition, the surface roughness of the development means is preferable to be smaller than the mean particle diameter of the non-magnetic single-component developer.

With the present invention, the surface roughness of the development means is smaller than the mean particle diameter of the non-magnetic single-component developer, whereby it is possible to prevent the non-magnetic single-component developer from sinking into or aggregating on the surface of the development means. Accordingly, the removal by the layer thickness restricting means of the non-magnetic single-component developer charged in reverse polarity can be done even better. Accordingly, with the present invention, in addition to the benefits mentioned above, there is obtained the additional benefit that the non-magnetic single-component developer can be charged even more uniformly and even more stably, whereby as a consequence whereof even better images can be formed even more stably.

In the present invention, it is preferable that, in addition, the potential difference between the potential Vd applied to the development means and the potential Vb on the layer thickness restricting means does not exceed the discharge breakdown voltage as based on the Paschen's law.

When the potential difference between the potential Vd applied to the development means and the potential Vb on the layer thickness restricting means exceeds the discharge breakdown voltage as based on Paschen's law, it becomes very difficult to stably maintain the potential Vb, but, in the present invention, that potential difference does not exceed this breakdown voltage. For this reason, the potential Vb can be stably maintained on the layer thickness restricting means, and the removal by the layer thickness restricting means of the non-magnetic single-component developer charged in reverse polarity can be performed with even greater stability. Accordingly, with the present invention, in addition to the benefits mentioned above, there is obtained the additional benefit that the non-magnetic single-component developer can be charged even more uniformly and even more stably, whereby even better images can be formed even more stably.

This and other objects, features and advantages of the present invention are described in or will become apparent from the following description of the preferred embodiments.

DESCRIPTION OF THE PREFERRED EMBODIMENTS

Figure 1:
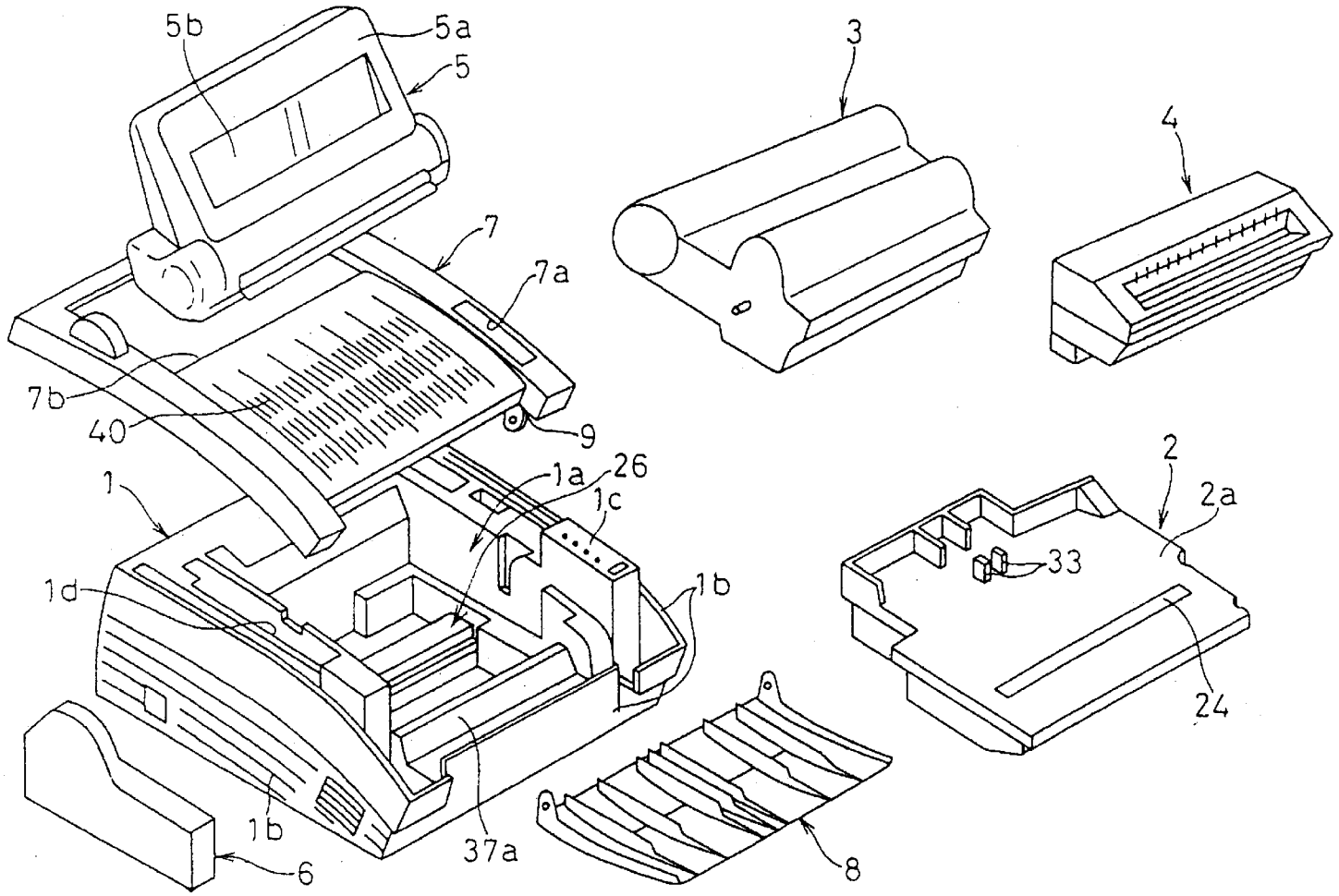
FIG. 1 is a perspective view of the main constitutional components in a laser printer in one embodiment.
Figure 2:
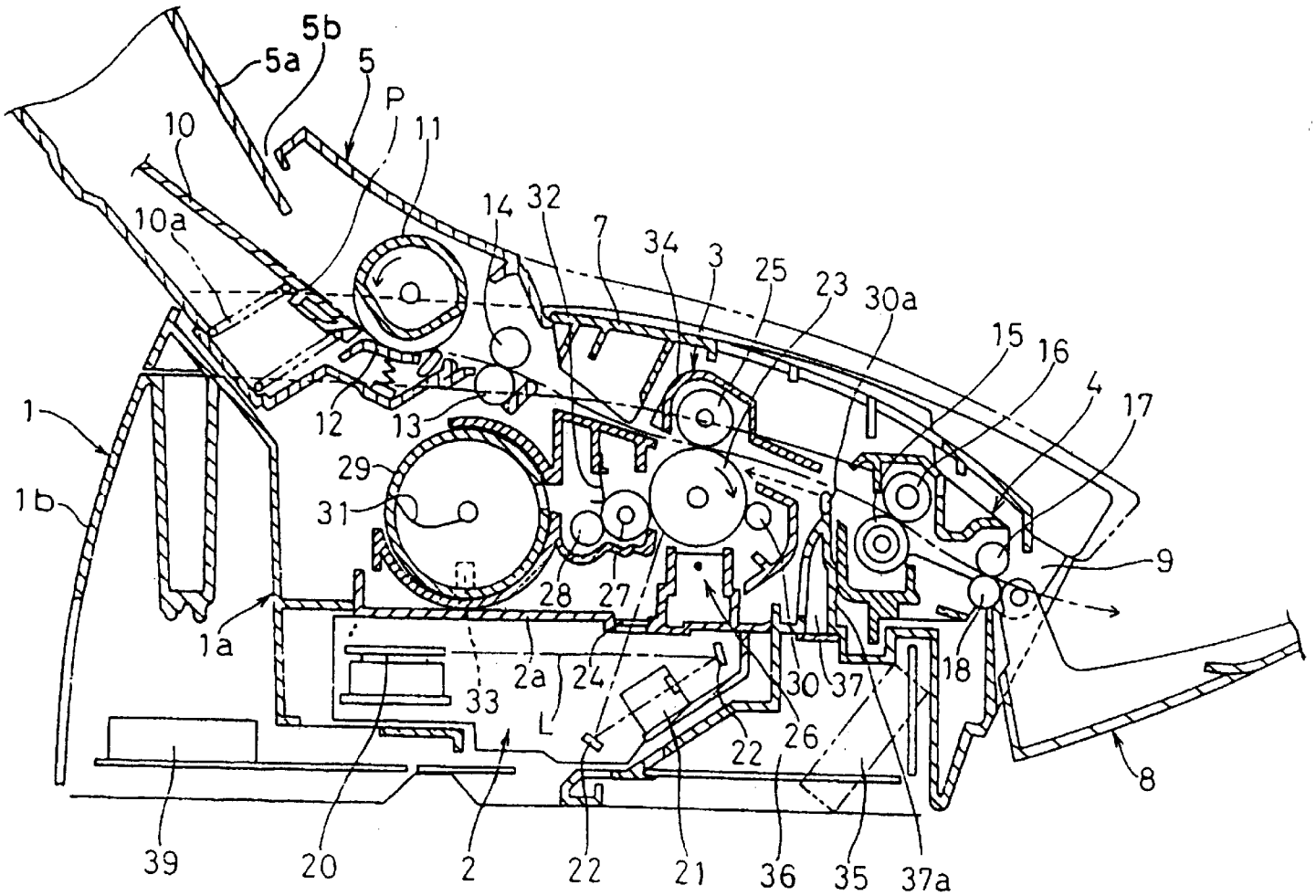
FIG. 2 is a simplified lateral cross-sectional view of the laser printer shown in FIG. 1.

Embodiments of the present invention are now described, making reference to the drawings. FIG. 1 is a perspective view of the main constitutional components in a laser printer cited as an image-forming apparatus in which the present invention is applied. FIG. 2 is a simplified lateral cross-sectional view of that laser printer.

In this laser printer, a main case 1 made of a synthetic resin, as shown in FIG. 1, comprises a main frame 1*a*, and a main cover 1*b* that covers the four outer circumferential (i.e. front, back, left, and right sides) surfaces of the main frame 1*a*. The main frame 1*a* and main cover 1*b* are formed integrally by injection molding, etc.

In the main frame 1*a*, from the top, are loaded a scanner unit 2 as the exposure unit, a process cartridge 3 as the image formation component, a fixing unit 4 as a fixing component, and a paper feeder unit 5.

A drive system unit 6 that includes a drive motor and gear train is loaded by inserting it from the bottom of the main case 1 into a housing cavity 1*d* between the left inner surface (in FIG. 1) of the main cover 1*b* and the left side of the main frame 1*a* as it comes nearer thereto, and there fixed in place. Also, in a top cover 7 that is a main unit cover, made of a synthetic resin, for covering the upper surfaces of the main frame 1*a* and main cover 1*b*, are formed a hole 7*a* through which is passed an operating panel component 1*c* that projects upwards on the right side of the main frame 1*a*, and a hole 7*b* through which is passed the base part of the paper feeder unit 5. The base part of a paper discharge tray 8 is attached to brackets 9 (only one of which is shown in FIG. 1) that protrude on the left and right sides at the front edge of the top cover 7, so that it can swing up and down. When not in use, the paper discharge tray 8 can be folded so that it covers the upper surface of the top cover 7.

Recording paper P, the recording medium, is set in a stacked condition inside a feeder case 5*a* in the paper feeder unit 5 As shown in FIG. 2, the leading end of the recording paper P is pressured toward a paper feed roller 11 by a support plate 10 activated by a spring 10*a* inside the feeder case 5*a*. Thus the recording paper P can be separated and sent to a pair of resist rollers 13 and 14 (upper and lower), one page at a time, by a separator pad 12 and the paper feed roller 11 that is turned by power transmitted from the drive system unit 6.

The process cartridge 3 forms images with toner T (cf. FIG. 3) on the surface of the separated recording paper P that is fed in by the resist rollers 13 and 14. The fixing unit 4 heats the recording paper P, on which toner T images have been formed, by sandwiching the recording paper P between a heating roller 15 and a pressure roller 16, thereby fixing the toner images on the recording paper P. A paper discharge section, comprising a paper discharge roller 17 and pinch roller 18, positioned on the downstream side inside the case of the fixing unit 4, discharges the recording paper P on which toner images have been fixed into the paper discharge tray 8. The recording medium conveyance route extends from the paper feed roller 11 to the paper discharge section A manual insertion slot 5*b* is provided in the paper feeder unit 5, opening diagonally upward, so that recording paper other than the recording paper P in the feeder case 5*a* can be inserted into the recording medium conveyance route and printed.

Positioned below the process cartridge 3 placed roughly in the center, as seen from above, of the main frame 1*a* that is shaped like a box open at the top in the main case 1, an upper support plate 2*a* on the scanner unit 2 is fixed by machine screws or the like to a stay formed integrally with the upper surface side of the bottom plate component of the main frame 1*a*. In the scanner unit 2 as the exposure unit, on the bottom surface side of the upper support plate 2*a* made of a synthetic resin, a laser generator unit (not shown), polygon mirror 20, lens 21, and reflecting mirror 22, etc., are positioned. In the upper support plate 2*a* is provided a glass plate 24 that covers a laterally long scanner hole formed so that it extends along the axis of a photosensitive drum 23 that is the electrostatic latent image carrier. A laser beam L emitted from the laser generator unit is directed onto the outer circumferential surface of the photosensitive drum 23 in the process cartridge 3 via the polygon mirror 20, reflecting mirror 22, lens 21, and glass plate 24, etc.

Figure 3:
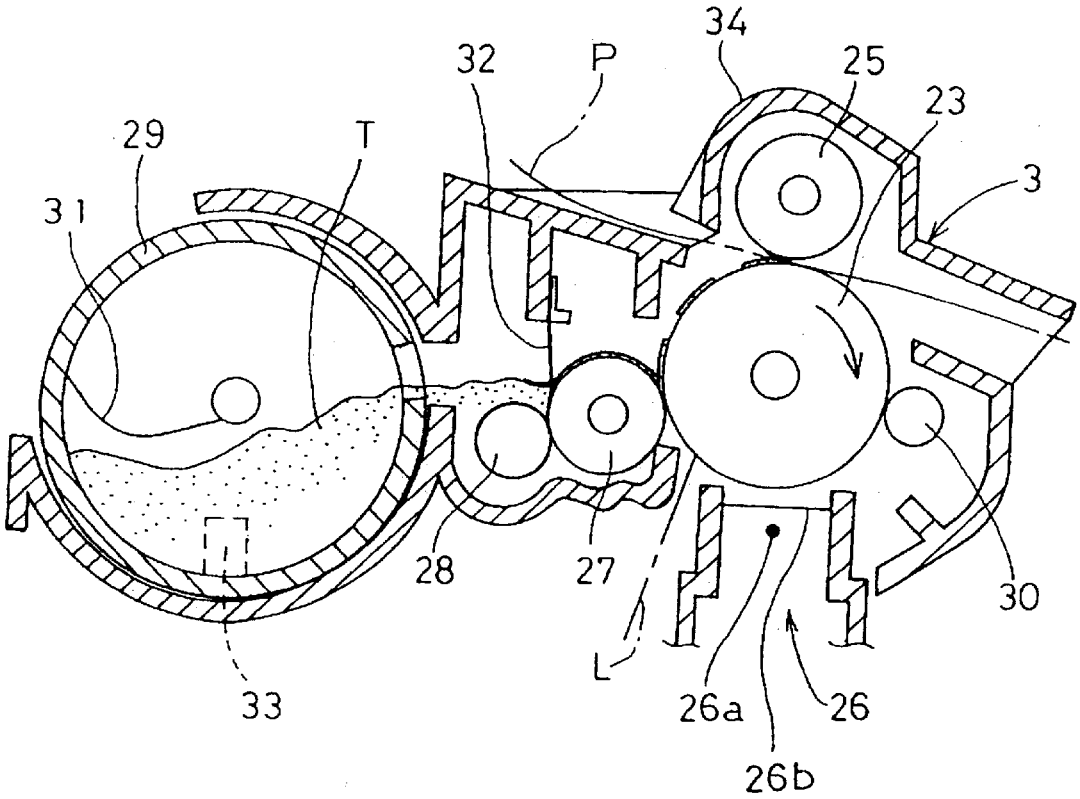
FIG. 3 is an enlarged view of the constitution of a process unit therein.

As shown in FIG. 2 and FIG. 3, the process cartridge 3 comprises; a development apparatus containing the photosensitive drum 23 and a transfer roller 25 in contact with the upper surface thereof, a development roller 27 that, as development means, is placed upstream from the photosensitive drum 23 in the direction of paper feed, and a supply roller 29 that, as supply means, is placed further upstream side; a developer supply unit placed yet further upstream side, that is, a toner cartridge 29 that is removably loadable in the process cartridge 3, and a cleaning roller 30, etc., positioned downstream side from the photosensitive drum 23. The process cartridge 3 is formed as a cartridge by assembling these component elements into a case 34 made of a synthetic resin. This process cartridge 3, formed thusly into a cartridge, is loaded in the main frame 1*a* such that it is removable. The photosensitive drum 23, development roller 27, and supply roller 28 all turn clockwise in FIG. 2.

Between the process cartridge 3 and fixing unit 4 is provided a static eliminating lamp 30*a* for static eliminating the photosensitive drum 23. Also, a charger 26 is provided below the photosensitive drum 23 The charger 26 is a commonly known positive-charge charging scorotron type of charger that comprises a discharge wire 26*a* made of tungsten, etc, and a grid electrode 26*b*, and is provided integrally on the upper surface of the upper support plate 2*a* of the scanner unit 2.

On the outer circumferential surface of the photosensitive drum 23, in a photosensitive layer charged by the charger 26, an electrostatic latent image is formed by the scanning of the laser beam L, modulated according to image information by the scanner unit 2 In other words, the scanner unit 2 corresponds to the electrostatic latent image-forming means. As is shown in the enlarged view in FIG. 3, the toner T that is stored inside the toner cartridge 29 as the developer is stirred by a stirrer 31 and released, after which it is carried via the supply roller 28 to the outer circumferential surface of the development roller 27, whereupon the thickness of the layer at the outer circumferential surface of the development roller 27 is restricted by a layer thickness restricting blade 32. The electrostatic latent image on the photosensitive drum 23 is made manifest (developed) by the adhesion of toner T from the development roller 27. The composition of this toner T and the development mechanism described above are described in greater detail below.

The image (toner image) formed on the photosensitive drum 23 by the toner T is transferred to the recording paper P that passes between the photosensitive drum 23 and the transfer roller 25 to which is applied a transfer bias having the reverse electric potential from the potential on the photosensitive drum 23, forming a toner image. The toner T remaining on the photosensitive drum 23 is temporarily collected by the cleaning roller 30, after which it is returned to the photosensitive drum 23 according to prescribed timing, and collected into the process cartridge 3 by the development roller 27.

On the upper support plate 2*a* (cf. FIG. 2) of the scanner unit 2 is provided a toner sensor 33 that projects upward. This toner sensor 33, which is made up of a light emitter and a photodetector, faces the inside of the lower cavity of the toner cartridge 29 in the process cartridge 3 so that it can detect the presence or absence of toner T inside the toner cartridge 29.

Returning to FIG. 2, on the lower surface side of the connecting part between the front of the main frame 1*a* and the front of the main cover 1*b*, a housing unit 36 is provided for housing a cooling fan 35, formed in conjunction with a ventilation duct 37 that extends left and right, perpendicular to the direction of passage of the recording paper P. The upper panel portion 37*a* of the ventilation duct 37 is formed such that its cross-sectional shape is that of an inverted V. This upper panel portion 37*a* is positioned between the process cartridge 3 and the fixing unit 4, so that the heat produced by the heating roller 15 in the fixing unit 4 is blocked from being transmitted directly to the process cartridge 3 side.

The cooling air flow produced by the cooling fan 35 passes through the interior of the ventilation duct 37, is conveyed along one lower side surface of the main frame 1*a*, and cools the power supply 39 and the drive motor in the drive system unit 6. At the same time, the cooling air flow passes inside the upper panel portion 37*a*, and is blown out from slits that open at multiple places on the process cartridge 3 side. This cooling air flow rises, passing between the process cartridge 3 and the fixing unit 4, and exits to the outside of the apparatus through multiple exhaust holes 40 (cf. FIG. 1) formed in the top cover 7.

The toner image development mechanism is next described First, the toner T stored in the toner cartridge 29 contains toner mother particles having a mean particle diameter of 9 $\mu$m formed by adding a known colorant such as carbon black, and charge controlling agents such as nigrosine, triphenyl methane, and quaternary ammonium salts, etc., to a styrene acrylic resin formed into beads by suspension polymerization. This toner T is known as a positive-chargeable non-magnetic single-component developer. This toner T, furthermore, is constituted with silica added as an additive to the surface of the toner mother particles. The silica used for the additive, moreover, is subjected to a known hydrophobic treatment using a silane coupling agent, etc., and this additive, with a mean particle diameter of 10 nm, is added in the amount of 0.6 wt % to the toner mother particles.

Figure 4:
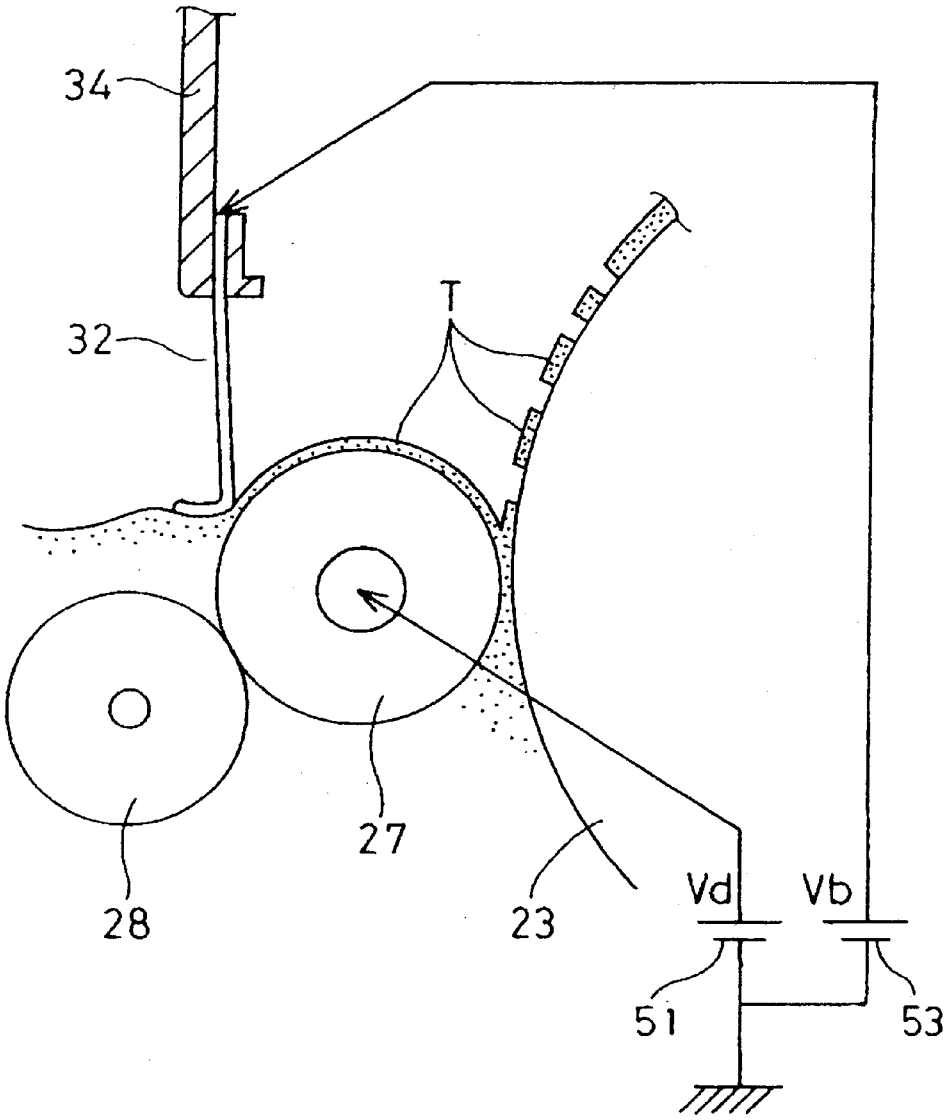
FIG. 4 is an explanatory diagram of the constitution of a potential control system in the process unit.

The supply roller 28 is a so-called foam roller constituted from a urethane foam exhibiting electrical conductivity. The development roller 27 is constituted in a cylindrical shape from silicone rubber or urethane rubber, exhibiting electrical conductivity by having dispersed therein electrically conductive particles such as carbon, or a filler. The surface of the development roller 27 has a coating layer containing fluorine formed on it The surface roughness Rz of the development roller 27 is 3 $\mu$m which is smaller than the mean particle diameter of the toner mother particles. For that reason, when the supply roller 28 and the development roller 27 turn in the direction noted while in mutual contact, and the toner T is rubbed between them, the toner T is readily friction-charged with positive polarity. The layer thickness restricting blade 32 is made of an electrically conductive metal such as SUS (stainless steel). DC power supplies 51 and 53 are connected respectively to the development roller 27 and the layer thickness restricting blade 32, as shown in FIG. 4. One terminal of each of the DC power supplies 51 and 53 is grounded. The DC power supply 51 applies a positive voltage Vd to the development roller 27, and the DC power supply 53 applies a positive voltage Vb to the layer thickness restricting blade 32.

The photosensitive drum 23 may be constituted, for example, by taking a grounded aluminum cylindrical sleeve and forming about the outer circumference thereof a photoconducting layer wherein a photoconducting resin is dispersed in a polycarbonate. For this reason, in the region where the development roller 27 and the photosensitive drum 23 are in mutual opposition, the positively charged toner T can be developed in a reverse developing mode, relative to the electrostatic latent image of plus polarity (positively charged) formed on the photosensitive drum 23. By taking the toner image developed in this way and transferring it to the recording paper P at the opposing position with the transfer roller 25, as described in the foregoing, the desired image can be formed on the recording paper P.

With this laser printer, the voltages Vb and Vd are set so that the relationship:

$$Vb>Vd+Vt$$

where Vt is the potential difference in the thickness direction of the toner T layer adhering to the development roller 27, and so that the amount of charging per unit mass of toner T adhering to the development roller 27 after passage of the layer thickness restricting blade 32 is the same (within a range of ±5%) when the voltage Vb is applied to the layer thickness restricting blade 32 and when the layer thickness restricting blade 32 and the development roller 27 have been given the same potential. The potential difference between the voltages Vb and Vd, moreover, is set so that the discharge breakdown voltage as based on the Paschen's law is not exceeded. That is, Vb and Vd (unit=V) are set so as to satisfy the relationship:

$$Vb-Vd<312+6.2\times T$$

where T is a thickness ($\mu$m) of toner T layer on development roller 27. With this laser printer, furthermore, the material, positional relationship, and contact pressure, etc., are specified for the development roller 27 and the supply roller 28 so that the toner T will be subjected to sufficient friction-charging for the development of the electrostatic latent images formed on the photosensitive drum 23, even when the layer thickness restricting blade 32 and the development roller 27 are given the same potential. In other words, the layer thickness restricting blade 32 corresponds to the layer thickness restricting means, and the DC power supplies 51 and 53 correspond to the potential control means, respectively. The potential difference Vt in the direction of toner T layer thickness was determined experimentally by measuring the potential at the surface of the toner T adhering to the surface of the development roller 27 with that development roller 27 grounded to earth.

Thus, with this laser printer, the effects and benefits noted below are realized. The applicant discovered that, if at least that portion of the layer thickness restricting blade 32 that comes into contact with the toner T adhering to the surface of the development roller 27 is constituted of an electrically conductive material and, at the same time, the potential Vb applied to the layer thickness restricting blade 32 is controlled to a potential that satisfies the relationship noted above, namely Vb>Vd+Vt, the toner T charged in reverse polarity (−) can be nicely removed by the layer thickness restricting blade 32. In this laser printer, positive voltages Vb and Vd that satisfy the above relationship are applied to the layer thickness restricting blade 32 and the development roller 27 by the DC power supplies 51 and 53, respectively. With this laser printer, therefore, toner T charged in reverse polarity and adhering to the surface of the development roller 27 can be nicely removed. Accordingly, good images can be formed which exhibit no fogging.

The toner T is very near to being spheroidal in shape, moreover, is a suspension polymer toner that excels in fluidity, and also has added thereto, as an additive, 0.5 wt % of silica that has been hydrophobic-treated and has a mean particle diameter of 30 nm or less, wherefore the fluidity is extremely outstanding. Also, a flourine-containing coating layer is formed on the surface of the development roller 27, wherefore the surface roughness thereof is smaller than the mean particle diameter of the toner T, thus making it possible to prevent the toner T from sinking into or catching on the surface of the development roller 27. Hence, with this laser printer, toner T charged in reverse polarity and adhering to the surface of the development roller 27 can be removed extremely well. Furthermore, comparatively good fluidity is realized, even when the toner T is made up of other polymer toner obtained by emulsion polymerization, and, even though this will be slightly inferior to the toner T noted above, similar benefits are obtained.

Also, the voltage Vb is set so that the amount of charging per unit mass of the toner T adhering to the development roller 27 after passage of the layer thickness restricting blade 32 will be roughly the same as if voltage Vb applied to the layer thickness restricting blade 32 had the same potential as the development roller 27. In addition, the development roller 27 and the supply roller 28 are constituted so that the toner T can be sufficiently charged for the development of the electrostatic latent images even when the layer thickness restricting blade 32 and the development roller 27 are given the same potential. In other words, with this laser printer, the action of injecting electrical charge to the toner T by applying the potential Vb to the layer thickness restricting blade 32 is not produced and, even without this action, the constitution is such that the toner T can be sufficiently charged by the friction-charging produced by the development roller 27 and the supply roller 28 working together.

Thus it is not influenced by the environment, differing in the case that the toner T is charged by electric charge injection. Also, the amount of charging in the toner T does not become excessive even after the toner T has been subjected to electric charge injection when passing the layer thickness restricting blade 32. That being so, with this laser printer, the toner T can be charged extremely uniformly and extremely stably, as a consequence of which extremely good images can be formed extremely stably. Furthermore, this laser printer is fashioned so that the potential difference between the voltages Vb and Vd does not exceed the discharge breakdown voltage as based on Paschen's law, wherefore the voltage Vb on the layer thickness restricting blade 32 can be maintained stably. Accordingly, with this laser printer, the toner T can be charged even more stably, as a consequence of which the benefit is realized of being able to form the good images noted above with even greater stability.

The present invention is in no way limited to or by the embodiments described in the foregoing, and can be implemented in various embodiments within such scope that the essence thereof is not compromised. For the additive, for example, besides the silica already noted, various other additives can be used such as alumina or titanium oxide, etc, so long as they have a mean particle diameter of 30 nm or less and are added in a quantity of 0.5 wt % or greater to the toner mother particles. It is also permissible to add additives having a mean particle diameter of 30 nm or greater (preferably 40 nm or greater) in a quantity of 0.8 wt % or less to the toner mother particles, mixed together with the additives noted above. If such additives are added excessively, they will act conversely to impair the fluidity of the toner T, but they can suppress the sinking in of the smaller additives (having a mean particle diameter of 30 nm or less, for example) into the toner mother particles. By adding a mixture of such large and small additives, the fluidity of the toner T is better maintained, and even better images can be formed even more stably. The toner mother particles should have a mean particle diameter of 6 $\mu$m to 10 $\mu$m, and the surface roughness Rz of the development roller should be from 3 $\mu$m to 4 $\mu$m.

The present invention may be applied similarly in an image-forming apparatus such as a copy machine wherein electrostatic latent images are formed by a laser beam L reflected from an original, and in image-forming apparatuses wherein the toner T is friction-charged by a layer thickness restricting blade 32. The present invention, furthermore, may also be applied to image-forming apparatuses which employ a negative-chargeable non-magnetic single-component developer. In that case, however, both the voltages Vb and Vd become negative voltages, and the following conditions (1) and (2) (preferably conditions (1) to (3)) should be satisfied.

Condition (1):

$Vb<Vd+Vt$

Condition (2):

The amount of charging per unit mass of toner T adhering to the development roller 27 when the voltage Vb is applied to the layer thickness restricting blade 32 is roughly equal to that when the layer thickness restricting blade 32 and the development roller 27 and given the same potential.

Condition (3):

$Vd-Vb<312+6.2\times T$ where T is a thickness ($\mu$m) of toner T layer on development roller 27.

It is not absolutely necessary that the amounts of charging in condition (2) as above is strictly the same; they may be different within a range of ±5%, for example.

The entire disclosure of the specification, claims, drawings and summary of Japanese Patent Application No. 10-11730 filed on Jan. 23, 1998 is hereby incorporated by reference in its entirety.

What is claimed is:

1. An image-forming apparatus comprising:

an electrostatic latent image carrier having a surface on which electrostatic latent images are formed;

development means for conveying charged non-magnetic single-component developer to the surface of the electrostatic latent image carrier and developing the electrostatic latent images, the development means also having a surface;

supply means for supplying the non-magnetic single-component developer to the development means; and layer thickness restricting means for restricting a layer thickness of the non-magnetic single-component developer adhering to the surface of the development means before the non-magnetic single-component developer faces the electrostatic latent image carrier, at least a part of the layer thickness restricting means contacting the non-magnetic single-component developer adhering to the surface of the development means is made of an electrically conductive material, where the non-magnetic single-component developer that has developed the electrostatic latent images is transferred to a recording medium, thereby forming images; wherein the non-magnetic single-component developer is roughly spheroidal in shape;

the development means, the supply means, and the layer thickness restricting means are constituted so that the non-magnetic single-component developer can be sufficiently charged for development of the electrostatic latent images, even if the layer thickness restricting means is given a same electric potential as the development means; and the image-forming apparatus further comprises:

electrical potential control means for controlling a potential Vb of the layer thickness restricting means so that conditions noted below are satisfied, at least during image formation;

condition 1 being the potential Vb satisfies the following relationships:

$Vb>Vd+Vt$; when a positive-chargeable non-magnetic single-component developer is used, and $Vb<Vd+Vt$; when a negative-chargeable non-magnetic single-component developer is used, where Vd is a potential applied to the development means during image formation, and Vt is a potential difference in a thickness direction of a layer of the non-magnetic single-component developer adhering to the development means; and condition 2 being that an amount of charging per unit mass of the non-magnetic single-component developer adhering to the development means when the potential Vb is applied to the layer thickness restricting means is roughly equal to an amount if the layer thickness restricting means had the same potential as the development means.

2. The image-forming apparatus according to claim 1, wherein the non-magnetic single-component developer comprises a polymeric toner obtained by polymerization.

3. The image-forming apparatus according to claim 2, wherein the polymer toner is a suspension-polymeric toner obtained by suspension polymerization.

4. The image-forming apparatus according to claim 1, wherein additives subjected to a hydrophobic treatment and having a mean particle diameter of 30 $\mu$m or less are added in a quantity of approximately 0.5 wt % or greater to the non-magnetic single-component developer.

5. The image-forming apparatus according to claim 1, wherein a surface roughness of the development means is smaller than a mean particle diameter of the non-magnetic single-component developer.

6. The image-forming apparatus according to claim 1, wherein a potential difference between potential Vd applied to the development means and potential Vb on the layer thickness restricting means does not exceed discharge breakdown voltage as based on Paschen's law.

* * * * *